US007827943B2

(12) United States Patent
Cannata

(10) Patent No.: US 7,827,943 B2
(45) Date of Patent: Nov. 9, 2010

(54) VARIABLE COMPRESSION RATIO SYSTEM

(75) Inventor: Antonio Cannata, London (CA)

(73) Assignee: Tonand Brakes Inc, London, Ontario (CA)

( * ) Notice: Subject to any disclaimer, the term of this patent is extended or adjusted under 35 U.S.C. 154(b) by 437 days.

(21) Appl. No.: 12/033,878

(22) Filed: Feb. 19, 2008

(65) Prior Publication Data

US 2009/0205615 A1 Aug. 20, 2009

(51) Int. Cl.
*F02B 75/04* (2006.01)
*F02D 15/02* (2006.01)

(52) U.S. Cl. ..... 123/48 B; 123/78 E

(58) Field of Classification Search ..... 123/48 B, 123/48 R, 48 AA, 48 A, 78 R, 78 AA, 78 A, 123/78 B, 78 BA, 78 E, 197.4, 197.3
See application file for complete search history.

(56) References Cited

U.S. PATENT DOCUMENTS

| | | | | |
|---|---|---|---|---|
| 4,140,091 | A | 2/1979 | Showers | |
| 4,227,587 | A | 10/1980 | Carman | |
| 4,469,055 | A * | 9/1984 | Caswell | 123/78 B |
| 4,864,977 | A * | 9/1989 | Hasegawa | 123/48 B |
| 5,136,987 | A * | 8/1992 | Schechter et al. | 123/48 B |
| 5,247,911 | A * | 9/1993 | Nenicka | 123/48 B |
| 5,724,863 | A * | 3/1998 | Kramer et al. | 74/583 |
| 6,202,623 | B1 * | 3/2001 | Ehrlich | 123/197.4 |
| 6,622,672 | B1 | 9/2003 | Styron et al. | |
| 6,719,080 | B1 | 4/2004 | Gray | |
| 7,021,254 | B2 * | 4/2006 | Shiraishi et al. | 123/78 E |
| 7,059,280 | B2 * | 6/2006 | Nohara et al. | 123/48 D |
| 7,273,122 | B2 | 9/2007 | Rose | |
| 2002/0050252 | A1 * | 5/2002 | Moteki | 123/48 B |

* cited by examiner

*Primary Examiner*—Michael Cuff
*Assistant Examiner*—Hung Q Nguyen
(74) *Attorney, Agent, or Firm*—Mark Sprigings; Gowling Lafleur Henderson

(57) ABSTRACT

A variable compression ratio system for use in a reciprocating-piston engine. The system allows the compression ratio in a combustion cylinder of the engine to be varied by varying the distance from a combustion chamber facing surface of a piston to the center of pivotal connection of a connecting rod to a crankshaft. The distance is varied responsive to the supply and withdrawal of pressurized hydraulic fluid. The hydraulic fluid is supplied and discharged by a slave pump pivotally connected to the connecting rod at a first end and pivotally connected to a stationary point at a second end. The slave pump supplies and withdraws hydraulic fluid responsive to the rotation of the crankshaft and a hydraulic backpressure controlled using a pressure control valve.

3 Claims, 5 Drawing Sheets

VARIABLE COMPRESSION RATIO SYSTEM

FIELD OF INVENTION

The present invention relates to the field of reciprocating-piston engines. In particular, to a variable compression ratio system for use in a reciprocating-piston engine.

BACKGROUND

With the growing concerns over environmental impacts and the every increasing cost of energy products, both producers and consumers of reciprocating-piston engines are interested in means to improve the operational efficiency of these engines. Significant advancements have been made in the ability to tailor the operating characteristics of these engines in the areas of fuel delivery, ignition, induction and exhaust control.

A significant characteristic in the tuning of engines for efficient operation is the compression ratio. Historically, engines have been designed to a fixed compression ratio that is a compromise between the needs at multiple operating points (i.e. combinations of engine speed and load). Several mechanisms that allow the compression ratio to be varied during operation of the engine have been proposed, some of these solutions include a hydraulic mechanism that operates on the engine pistons or connecting rods to change the piston stroke. Two significant considerations in the design of such a hydraulic mechanism are: first, that the hydraulic fluid must be exchanged sufficiently frequently to prevent overheating of the fluid; and second, that overall flow of hydraulic fluid is preferably minimized so as to mitigate the pumping requirements (e.g. the energy consumed) and also to allow sufficient fluid to be exchanged in the limited time available during each engine cycle as the speed of the engine (i.e. revolutions per minute) increases. The previously known hydraulic mechanisms for varying the compression ratio typically either require large flows of hydraulic fluid (e.g. in some cases a continuous flow) or do not have provision to exchange the hydraulic fluid sufficiently often to prevent overheating of the fluid.

What is needed is a variable compression ratio system that provides for the compression ratio in a reciprocating-piston engine to be varied using hydraulic means where the overall flow of hydraulic fluid is minimized while being sufficient to provide for cooling of the fluid.

SUMMARY OF INVENTION

A variable compression ratio system for use in a reciprocating-piston engine. The system allows the compression ratio in a combustion cylinder of the engine to be varied by varying the distance from a combustion chamber facing surface of a piston to the center of pivotal connection of a connecting rod to a crankshaft. The distance is varied responsive to the supply and withdrawal of pressurized hydraulic fluid. The hydraulic fluid is supplied and discharged by a slave pump pivotally connected to the connecting rod at a first end and pivotally connected to a stationary point at a second end. The slave pump supplies and withdraws hydraulic fluid responsive to the rotation of the crankshaft and a hydraulic backpressure controlled using a pressure control valve.

In accordance with one aspect of the present invention, there is provided a variable compression ratio system for use in a reciprocating-piston engine having a combustion cylinder and a crankshaft, the variable compression ratio system comprising: a hydraulically operated variable length mechanism; a source for supplying pressurized hydraulic fluid having an injection check valve permitting flow of hydraulic fluid from the source and blocking flow in the opposite direction; a sink for receiving pressurized hydraulic fluid having a pressure control valve for providing a variable degree of resistance to the flow of hydraulic fluid to the sink responsive to a control signal; a slave hydraulic pump for alternatively supplying and withdrawing hydraulic fluid to and from the variable length mechanism; and a control unit for providing the control signal, wherein a degree of resistance provided by the pressure control valve, responsive to the control signal, is in accordance with a desired compression ratio.

The variable length mechanism having: an engine piston for reciprocation in the combustion cylinder and for enclosing a combustion-chamber at a first end of the combustion cylinder; a connecting rod pivotally connected to the engine piston at a first end and pivotally connected to the crankshaft at a second end; a hydraulic cylinder for varying, responsive to alternatively a supply and a withdrawal of hydraulic fluid, a distance from a combustion-chamber facing surface of the engine piston to the center of the pivotal connection of the connection rod to the crankshaft; and a biasing mechanism for resisting the increasing of the distance and wherein the degree of resistance increases as the distance increases.

The slave hydraulic pump having: a first end pivotal connected to the connecting rod arranged so that the slave hydraulic pump completes one intake stroke and one discharge stroke for each revolution of the crankshaft; a hydraulic connection to the source for receiving pressurized hydraulic fluid on the intake stroke; a hydraulic connection to the sink for discharging pressurized hydraulic fluid on the discharge stroke; and a commutating valve operable, responsive to rotation of the crankshaft, between an open position proximate a pre-determined rotational position of the crankshaft and a closed position at all other rotational positions of the crankshaft, and, when in the open position, the commutating valve providing a hydraulic connection between the slave hydraulic pump and the hydraulic cylinder allowing hydraulic pressures in the slave hydraulic pump and the hydraulic cylinder to equalize.

Wherein the degree of resistance provided by the pressure control valve creates a backpressure in the slave hydraulic pump, the equalization of the hydraulic pressures in the slave hydraulic pump and the hydraulic cylinder resulting in alternatively the supply and withdrawal of hydraulic fluid to and from the hydraulic cylinder response to a pressure differential, the distance from the combustion-chamber facing surface of the engine piston to the center of the pivotal connection of the connection rod to the crankshaft alternatively increasing and decreasing responsive to the volume of hydraulic fluid alternatively supplied and withdrawn from the hydraulic cylinder, and the compression ratio of the engine increasing when the distance is increased and the compression ratio decreasing when the distance is decreased.

Other aspects and features of the present invention will become apparent to those ordinarily skilled in the art or science to which it pertains upon review of the following description of specific embodiments of the invention in conjunction with the accompanying figures.

BRIEF DESCRIPTION OF DRAWINGS

The present invention will be described in conjunction with drawings in which.

DETAILED DESCRIPTION

Figure 1:
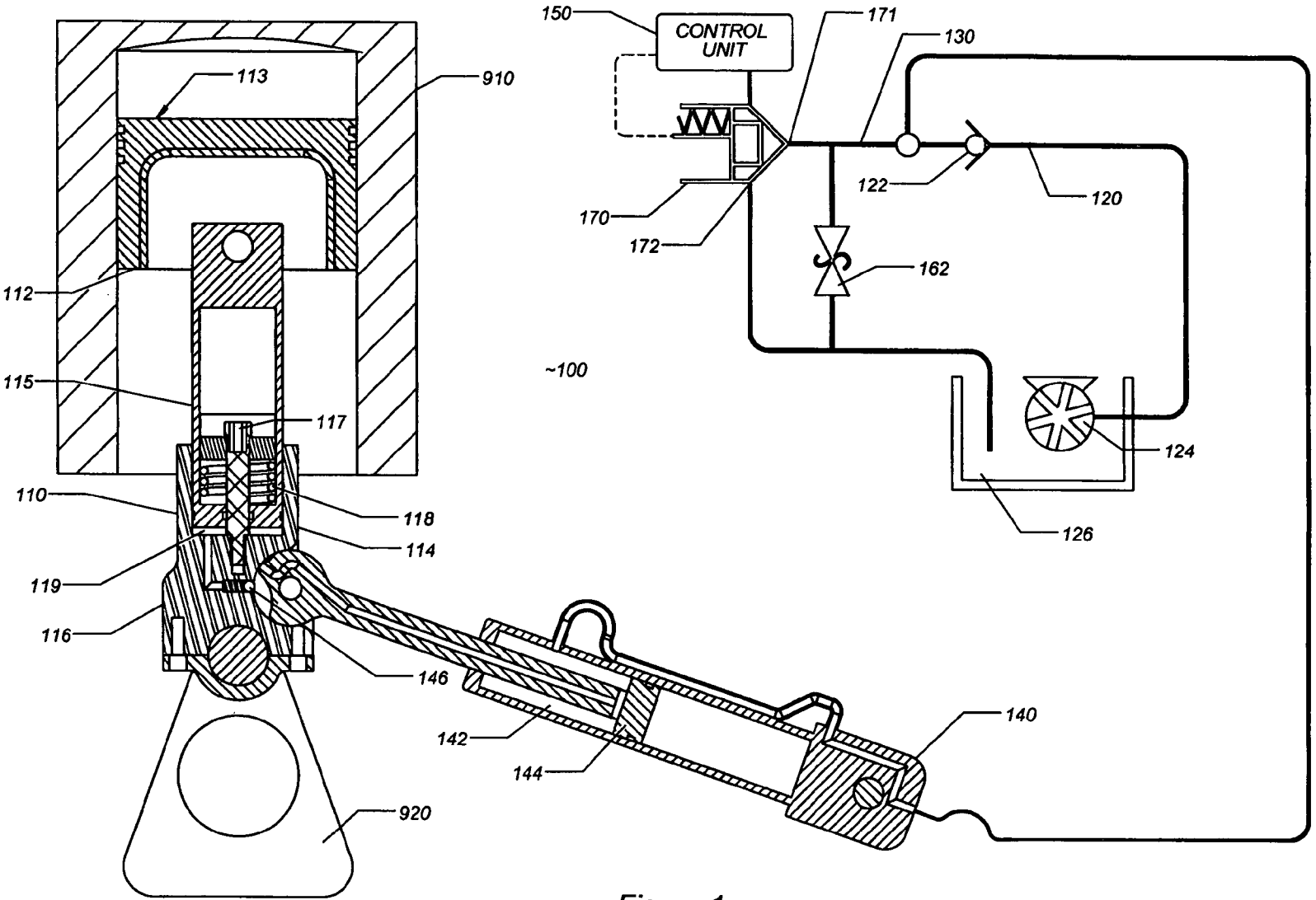
FIG. 1 is a schematic representation of an exemplary variable compression ratio system for use in a reciprocating-piston engine.

FIG. 1 is a schematic representation of an exemplary variable compression ratio system 100 for use in a reciprocating-piston engine. The reciprocating-piston engine has at least one combustion cylinder 910 and a crankshaft 920 for converting the reciprocating motion of a piston 112 to rotational motion. The reciprocating-piston engine can be any of the well-known reciprocating piston type engines operating in a four-stroke or a two-stroke mode of operation. While the variable compression ratio system 100 is described herein with reference to a four-stoke, spark ignition (i.e. Otto cycle) engine, the variable compression ratio system 100 is equally applicable to other well known reciprocating piston engine types. The variable compression ratio system 100 comprises a hydraulically operated variable length mechanism 110, a source 120 for supplying pressurized hydraulic fluid, a sink 130 for discharging pressurized hydraulic fluid, a slave hydraulic pump 140 and a control unit 150.

The variable length mechanism 110 comprises the engine piston 112 and a connecting rod 114. The engine piston 112 is adapted to reciprocation in the combustion cylinder 910 and to enclosing a combustion chamber at a one end of the combustion cylinder 910. The connecting rod 114 is pivotally connected at a first end to the engine piston 112, using any well-known mechanism such as a wrist pin, and is pivotally connected at a second end to the crankshaft 920 using any well-known mechanism such as a journal and bearing. The connecting rod 114, in conjunction with a throw of the crankshaft 920, provides for the conversion of the reciprocating motion of the engine piston 112 into rotational motion of the crankshaft 920 and vice versa. The connecting rod 114 comprises a piston-end member 115 that is slideably connected to a crankshaft-end member 116. The piston-end member 115 slides in a bore in the crankshaft-end member 116 to form a hydraulic cylinder 119. The piston-end member 115 is prevented from disengaging the bore in the crankshaft-end member 116 by a retaining bolt 117. A spring 118, or other similar biasing mechanism, biases the piston-end member 115 relative to the crankshaft-end member 116 in order to shorten the distance between the pivotal connection to the engine piston 112 (as measured from the rotational center) and the pivotal connection to the crankshaft 920 (as measured from the rotational center). By introducing, into the hydraulic cylinder 119, hydraulic fluid of sufficient pressure to overcome the resistance of the spring 118 the piston-end member 115 can be moved relative to the crankshaft-end member 116 in order to lengthen the distance between the pivotal connection to the engine piston 112 and the pivotal connection to the crankshaft 920. The distance from the pivotal connection to the engine piston 112 (as measured from the rotational center) to a combustion chamber facing surface 113 of the engine piston 112 is fixed. Therefore, lengthening and shortening the distance between the pivotal connection to the engine piston 112 and the pivotal connection to the crankshaft 920 respectively lengthens and shortens the distance between the combustion chamber facing surface 113 of the engine piston 112 and the pivotal connection to the crankshaft 920. By lengthening and shortening the distance between the combustion chamber facing surface 113 of the engine piston 112 and the pivotal connection to the crankshaft 920 the compression ratio in the combustion cylinder 910 is also varied.

Figure 2:
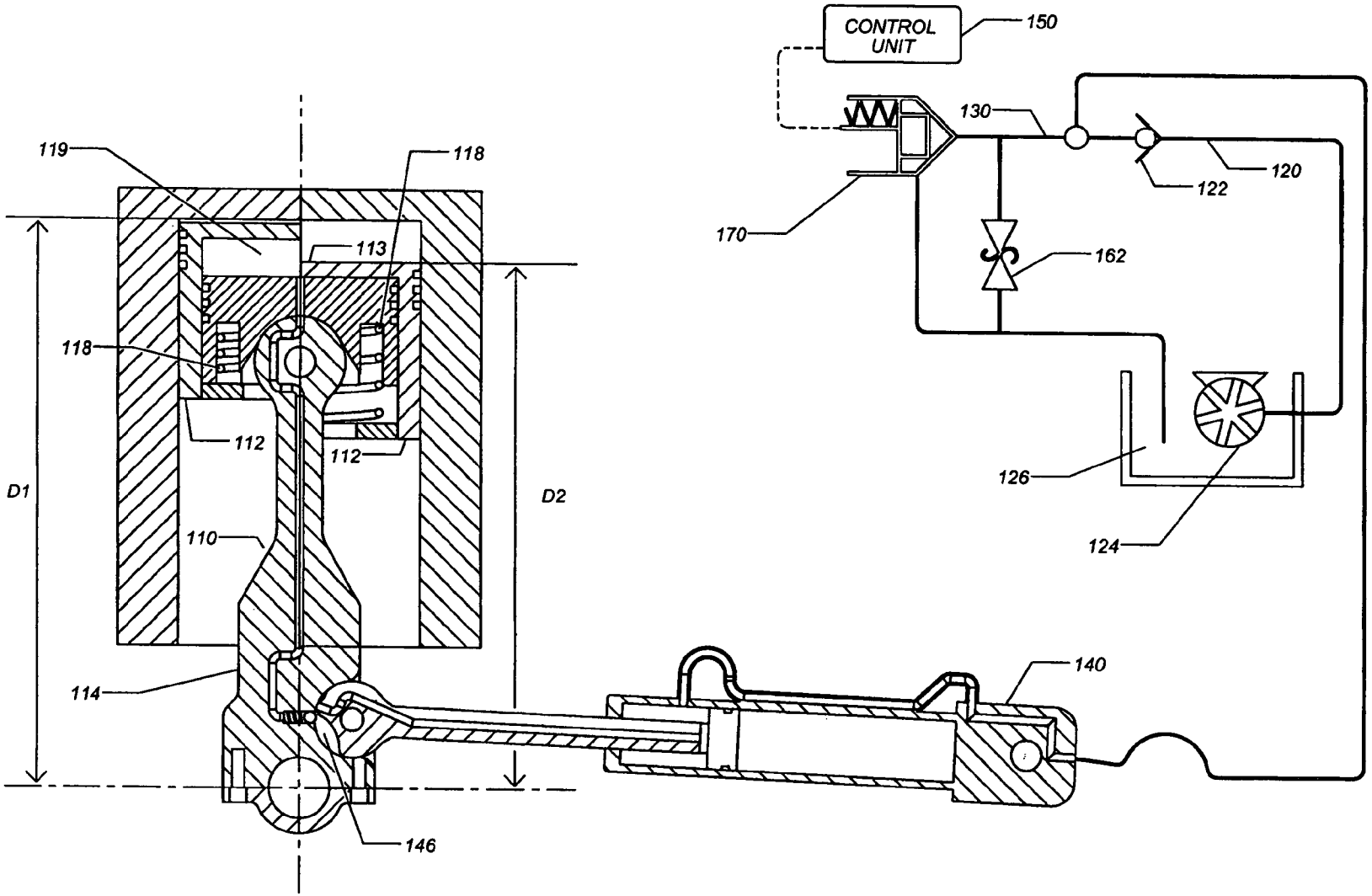
FIG. 2 is a schematic representation of an alternative exemplary embodiment of the variable compression ratio system having an alternative embodiment of a variable length mechanism.

FIG. 2 is a schematic representation of an alternative exemplary embodiment of the variable compression ratio system 100 having an alternative embodiment of the variable length mechanism 110 in which the connecting rod 114 is a fixed length and the engine piston 112 is of variable length. The variable length engine piston 112 provides for the distance from the pivotal connection to the connecting rod 114 (as measured from the rotational center) to the combustion chamber facing surface 113 of the engine piston 112 to be lengthened and shortened by hydraulic means. The variable length engine piston 112 in combination with the fixed length connecting rod 114 provide for the distance from the combustion chamber facing surface 113 of the engine piston 112 to the pivotal connection of the connecting rod 114 to the crankshaft 920 to be varied. FIG. 2 is a split view with the left side of the engine piston 112 illustrated in a position for maximum distance from the combustion chamber facing surface 113 of the engine piston 112 to the pivotal connection of the connecting rod 114 to the crankshaft 920 as indicated by D1 and the right side of engine piston 112 illustrated in a position for minimum distance from the combustion chamber facing surface 113 of the engine piston 112 to the pivotal connection of the connecting rod 114 to the crankshaft 920 as indicated by D2. Hydraulic communications to the hydraulic cylinder 119 in the engine piston 112 is provided through the connecting rod 114. The effect of a fixed length connecting rod 114 in combination with the variable length piston 112, with respect to the compression ratio, is equivalent to that of the variable length connecting rod 114 in combination with the fixed length piston as described above with reference to FIG. 1.

Figure 3:
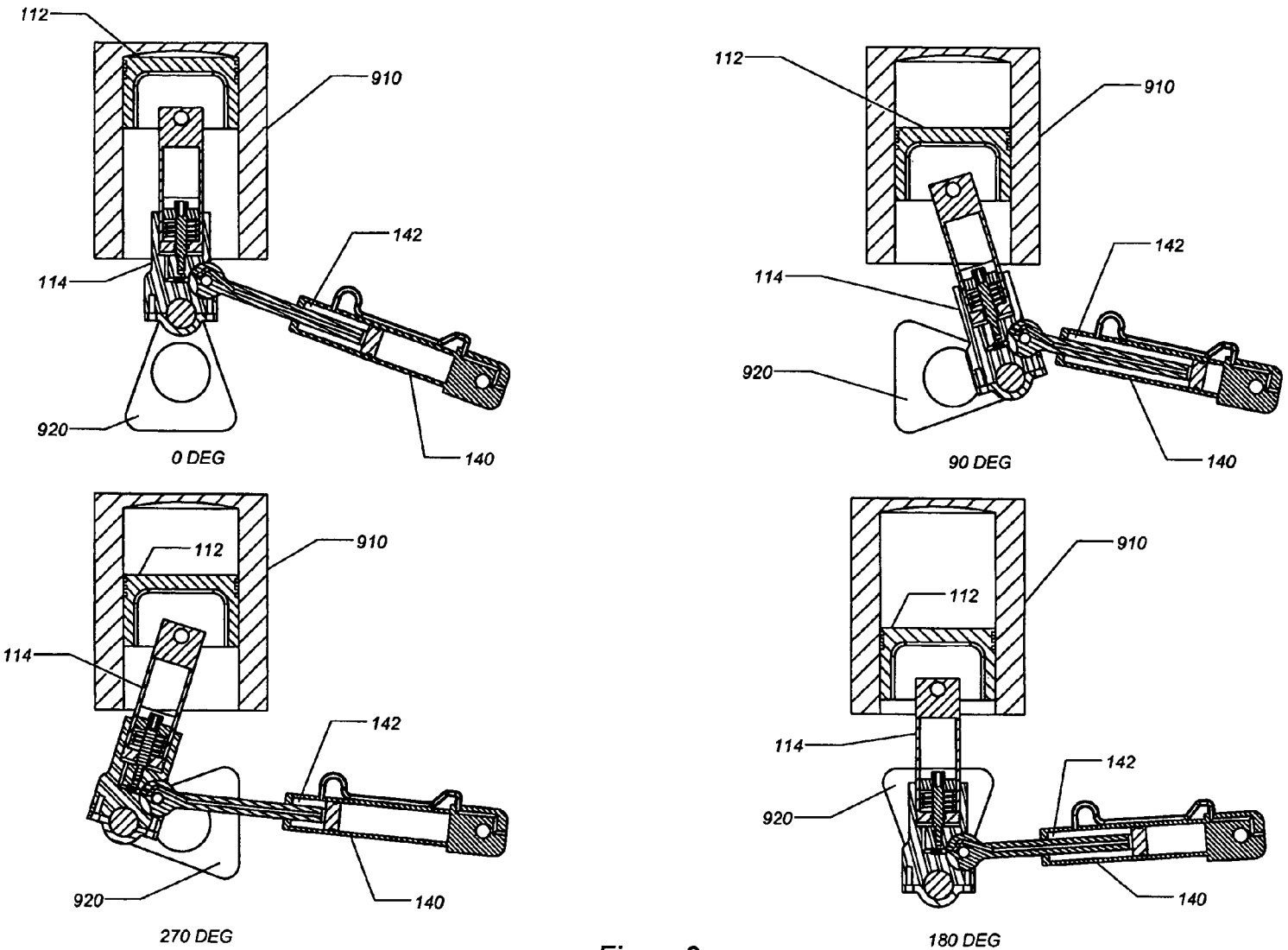
FIG. 3 is a schematic representation of the position and extension of a slave hydraulic pump at four illustrative points in the rotation of the engine crankshaft.

The slave hydraulic pump 140 is pivotally connected to the connecting rod 114 at a first end and to a point that is stationary relative to the rotational center of the crankshaft 920 at a second end. The connection points of the slave hydraulic pump 140 are arranged so that the slave hydraulic pump 140 cycles through one intake and one discharge stroke for one complete rotation of the crankshaft 920. FIG. 3 is a schematic representation of the position and extension of the slave hydraulic pump 140 at four illustrative points in the rotation of the crankshaft 920. FIG. 3 represents the positions of the slave hydraulic pump 140, the piston 112, and the connecting rod 114 for positions of the crankshaft 920 at 0, 90, 180 and 270 degrees after top-dead-center (TDC) of the engine piston 112. The TDC position corresponds to the 0 (zero) degree position for the purposes of this document. Referring again to FIG. 1, the slave hydraulic pump 140 has a pumping chamber 142 in which a pumping piston 144 reciprocates. The pumping chamber 142 is in intermittent fluid communications with the hydraulic cylinder 119 in the variable length mechanism 110 via a commutating valve 146. The pumping chamber 142 is also in fluid communication with the source 120 of pressurized hydraulic fluid via an injection check valve 122 and with the sink 130 for pressurized hydraulic fluid.

Figure 4:
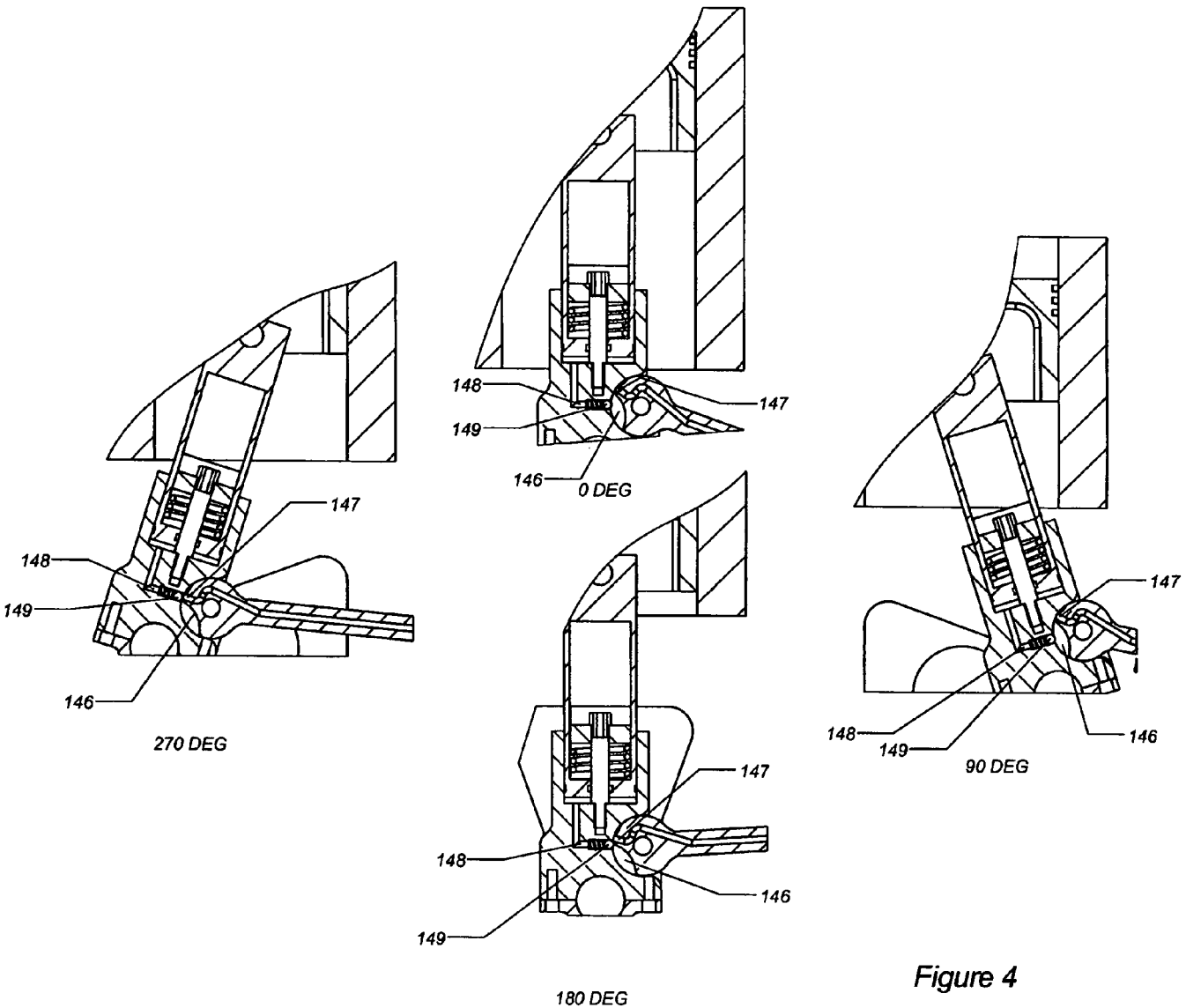
FIG. 4 is an expanded partial view of the schematic representation of FIG. 3 showing details of a commutating valve.

FIG. 4 is an expanded partial view of the schematic representation of FIG. 3 showing details of the commutating valve 146. The commutating valve 146 comprises hydraulic port 147 in the slave hydraulic pump 140 and hydraulic port 148 in the connecting rod 114 that are arranged for fluid communication (i.e. the commutating valve 146 is open) proximate to a pre-determined angular position (e.g. 270 degrees after TDC in the illustrated example) of the crankshaft 920 and for blocking fluid communication (i.e. the commutating valve 146 is closed) at all other angular positions of the crankshaft 920. The commutating valve 146 can optionally further comprise a ball valve 149 to provide a positive closing of the commutating valve 146 when not in the pre-determined position (e.g. 270 degrees after TDC) for opening of the commutating valve 146. In an alternative embodiment (not illustrated) the commutating valve 146 can be any other well-known valve mechanism that permits fluid communication (i.e. opens) proximate a predetermined angular position and blocks fluid communication (i.e. is closed) at all other angular positions.

Referring again to FIG. 1, the source 120 of pressurized hydraulic fluid comprises a pump 124 such as, for example, a lubricating pump for the engine, connected to a reservoir 126 of hydraulic fluid such as, for example, the engine oil pan (i.e. sump). In an alternative embodiment (not illustrated) any other well-known similar source of pressurized fluid can be used. The source 120 of pressurized hydraulic fluid further comprises the injection check valve 122 that permits the flow of pressurized hydraulic fluid from the pump 124 to the pumping chamber 142 and prevents flow in the opposite direction.

The sink 130 for pressurized hydraulic fluid comprises a reservoir 126 for hydraulic fluid such as, for example, the engine oil pan (i.e. sump) and a pressure control valve 170. The sink 130 further comprises an optional pressure relief valve 162.

With each revolution of the crankshaft 920, the commutating valve 146 opens once and permits the pressure in the hydraulic cylinder 119 to equalize with the pressure in the pumping chamber 142. In a preferred embodiment, the commutating valve 146 is open proximate 270 degrees after TDC. As the pressures are equalized, hydraulic fluid is exchanged between the hydraulic cylinder 119 in the variable length mechanism 110 and the pumping chamber 142 of the slave hydraulic pump 142. This exchange of hydraulic fluid ensures that hydraulic fluid in the variable length mechanism 110 is provided with an opportunity to dissipate heat. The flow of hydraulic fluid is minimized, as only a volume of hydraulic fluid sufficient to equalize the pressure needs to be exchanged. In a preferred embodiment the maximum volume of the pumping chamber 142 is less than the maximum volume of the hydraulic cylinder 119 in order to mitigate the volume of hydraulic fluid pumped by the slave hydraulic pump 140 in each revolution of the crankshaft 920.

Referring again to FIG. 3, as the crankshaft 920 rotates and the engine piston 112 reciprocates, the pumping piston 144 of the slave hydraulic pump 140 also reciprocates in the pumping chamber 142. In a preferred embodiment, the connection of the slave hydraulic pump 140 to the connecting rod 114 is arranged so that the volume of the pumping chamber 142 is maximized when the engine piston 112 is proximate 90 degrees after its TDC position in the combustion cylinder 910. The volume of the pumping chamber 142 is minimized when the engine piston 112 is proximate 270 degrees after the TDC position. For the illustrative four-stroke spark ignition engine, 90 degrees after TDC corresponds to substantially the mid-way point of the intake and power strokes of the combustion cylinder 910 and 270 degrees after TDC corresponds to substantially the mid-way point of the compression and exhaust strokes.

Referring again to FIG. 1, the pump 124 provides pressurized hydraulic fluid to fill the pumping chamber 142 when the volume of the pumping chamber 142 is expanding. The hydraulic fluid supplied by the pump 124 ensures that no cavitations occur. The introduction of hydraulic fluid from the pump 124 also promotes cooling of the slave hydraulic pump 140.

When the volume of the pumping chamber 142 is decreasing, hydraulic fluid must be expelled. The hydraulic fluid is expelled toward the sink 130 (i.e. toward the reservoir 126). The pressure control valve 170 is connected between the pumping chamber 142 and the reservoir 126. The pressure control valve 170 restricts the flow of hydraulic fluid from an inlet port 171, in fluid communication with the pumping chamber 142, and an outlet port 172, in fluid communication with the reservoir 126, responsive to a control signal received from the control unit 150. The degree to which the pressure control valve 170 restricts the flow of hydraulic fluid can be varied in accordance with the control signal. The control signal can be adjusted to provide for the pressure control valve 170 to create a specific pressure drop between the inlet port 171 and the outlet port 172. The restriction of flow through the pressure control valve 170 creates backpressure on the pumping chamber 142. When the crankshaft 920 reaches the pre-determined position (e.g. 270 degrees after TDC), the commutating valve 146 opens and the pressure in the hydraulic chamber 119 equalizes with the pressure in the pumping chamber 142 (i.e. with the backpressure created by the pressure control valve 170).

The flow of hydraulic fluid into the hydraulic cylinder 119 of the variable length mechanism 110 is opposed by the spring 118. The spring 118 is a progressive rate device wherein the pressure required to compress the spring increases as the spring is further compressed. The control unit 150 can effectively control the volume of hydraulic fluid present in the variable length mechanism 110 and thereby control the distance between the combustion chamber facing surface 113 of the engine piston 112 and the pivotal connection to the crankshaft 920 by adjusting the backpressure created by the pressure control valve 170. A shorter distance between the combustion chamber facing surface 113 of the engine piston 112 and the pivotal connection to the crankshaft 920 results in a relatively lower compression ratio in the combustion cylinder 910 while a greater distance results in a relatively higher compression ratio.

The variable compression ratio system 100 can control the compression ratio to any of a continuum of valves ranging from a compression ratio corresponding to the shortest possible distance D2 between the combustion chamber facing surface 113 of the engine piston 112 and the pivotal connection to the crankshaft 920 (i.e. with substantially no hydraulic fluid in the hydraulic cylinder 119) to a compression ratio corresponding to the longest possible distance D1 between the combustion chamber facing surface 113 of the engine piston 112 and the pivotal connection to the crankshaft 920 (i.e. with the hydraulic cylinder 119 filled to maximum volume with hydraulic fluid). More than one revolution of the crankshaft 920 can be required to alternatively supply or discharge a sufficient volume of hydraulic fluid to/from the hydraulic cylinder 119 to effect a change from a current compression ratio to a different desired compression ratio.

For each cycle of operation (i.e. each revolution of the crankshaft) the volumes of hydraulic fluid respectively supplied by the pump 124 and discharged by the pressure control valve 170 are each typically less than the maximum volume of the pumping chamber 142. The pumping requirement (i.e. demand) for the pump 124 is equal to or less than the maximum volume of the pumping chamber 142 per revolution of the crankshaft. The pump 124 preferably has a maximum pumping capacity not less than the equivalent of the maximum volume of the pumping chamber 142 per revolution of the crankshaft.

The pressure relief valve 162 is also connected between the pumping chamber 142 and the reservoir 126. The pressure relief valve 162 is normally closed (i.e. does not permit fluid flow). When the hydraulic pressure at an inlet port of the pressure relief valve 162 exceeds a pre-determined threshold, the pressure relief valve 162 opens allowing hydraulic fluid to flow toward the reservoir 126. The pressure relief valve 162 can protect the variable compression ratio system 100 from being damaged by inadvertently high hydraulic pressure.

The control unit 150 provides a control signal to the pressure control valve 170 to regulate the pressure differential between the inlet port 171 and the outlet port 172. The regulation of the pressure differential restricts the flow of hydraulic fluid through the pressure control valve 170 and creates a backpressure in the pumping chamber 142 and, when the commutating valve 146 is open, in the hydraulic cylinder 119 thereby controlling the compression ratio in the combustion chamber 910. In an alternative embodiment (not illustrated) the control unit 150 can interact with other engine management systems such as, for example, ignition control, fuel management, and variable-valve-timing control.

Figure 5:
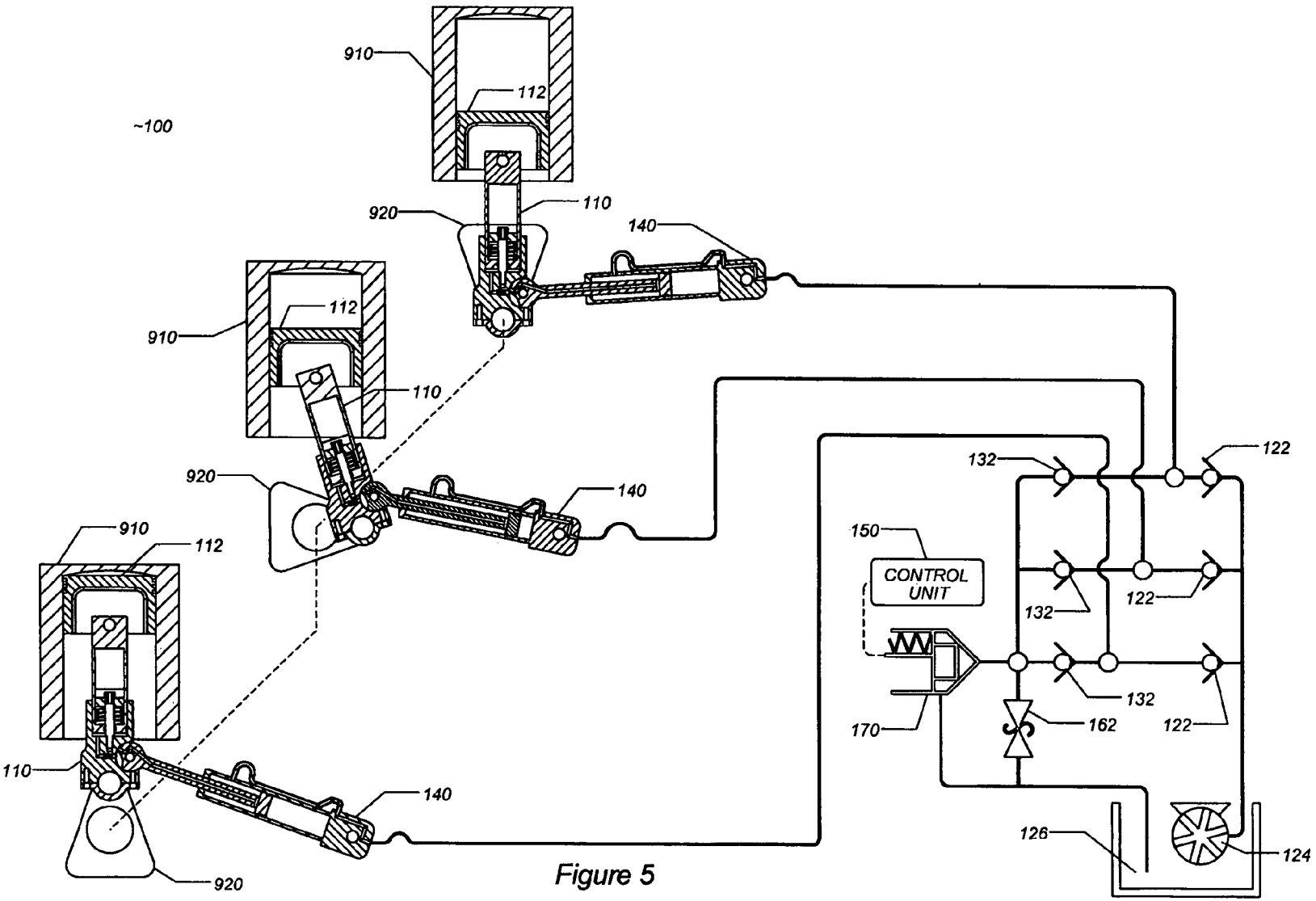
FIG. 5 is a schematic representation of another alternative exemplary embodiment of a variable compression ratio system for an engine having three combustion cylinders.

FIG. 5 is a schematic representation of another alternative exemplary embodiment of a variable compression ratio system 100 for a reciprocating-piston engine having three combustion cylinders 910. Each of the three combustion cylinders 910 is illustrated separately (i.e. exploded view) for clarity only, it will be understood that the combustion cylinders 910 are each connected to each other via connection to a common crankshaft 920 as indicated by the chain line passing through the center of rotation for each of the segments of the crankshaft 920 as illustrated. In an embodiment where the reciprocating-piston engine has more than one combustion cylinder 910, a separate variable length mechanism 110 is used in each combustion cylinder 910 and a separate slave hydraulic pump 140 is connected each variable length mechanism 110. Each combustion cylinder 910 has an associated injection check valve 122 and a discharge check valve 132. The discharge check valve 132 permits the flow of pressurized hydraulic fluid toward the reservoir 126 and prevents flow in the opposite direction. The discharge check valves 132 isolate each slave hydraulic pump 140 from the other slave hydraulic pumps 140. The pump 124, reservoir 126 for hydraulic fluid, the pressure control valve 170, the pressure relief valve 162, and the control unit 150 are common and shared by all of the combustion cylinders 910. The combination of slave hydraulic pump 140 and the variable length mechanism 110 associated with each of the combustion cylinders 910 operate substantially as described above with reference to FIG. 1 and independently of the of slave hydraulic pumps 140 and the variable length mechanisms 110 associated with each of the other combustion cylinders 910.

It will be apparent to one skilled in the art that numerous modifications and departures from the specific embodiments described herein may be made without departing from the spirit and scope of the present invention.

The invention claimed is:

1. A variable compression ratio system for use in a reciprocating-piston engine having a combustion cylinder and a crankshaft, the variable compression ratio system comprising:

a hydraulically operated variable length mechanism having:

a engine piston for reciprocation in the combustion cylinder and for enclosing a combustion-chamber at a first end of the combustion cylinder;

a connecting rod pivotally connected to the engine piston at a first end and pivotally connected to the crankshaft at a second end;

a hydraulic cylinder for varying, responsive to alternatively a supply and a withdrawal of hydraulic fluid, a distance from a combustion-chamber facing surface of the engine piston to the center of the pivotal connection of the connection rod to the crankshaft; and a biasing mechanism for resisting the increasing of the distance and wherein the degree of resistance increases as the distance increases;

a source for supplying pressurized hydraulic fluid having an injection check valve permitting flow of hydraulic fluid from the source and blocking flow in the opposite direction;

a sink for receiving pressurized hydraulic fluid having a pressure control valve for providing a variable degree of resistance to the flow of hydraulic fluid to the sink responsive to a control signal;

a slave hydraulic pump for alternatively supplying and withdrawing hydraulic fluid to and from the variable length mechanism having:

a first end pivotally connected to the connecting rod arranged so that the slave hydraulic pump completes one intake stroke and one discharge stroke for each revolution of the crankshaft;

a hydraulic connection to the source for receiving pressurized hydraulic fluid on the intake stroke;

a hydraulic connection to the sink for discharging pressurized hydraulic fluid on the discharge stroke; and a commutating valve operable, responsive to rotation of the crankshaft, between an open position proximate a pre-determined rotational position of the crankshaft and a closed position at all other rotational positions of the crankshaft, and, when in the open position, the commutating valve providing a hydraulic connection between the slave hydraulic pump and the hydraulic cylinder allowing hydraulic pressures in the slave hydraulic pump and the hydraulic cylinder to equalize; and a control unit for providing the control signal, wherein a degree of resistance provided by the pressure control valve, responsive to the control signal, is in accordance with a desired compression ratio;

wherein the degree of resistance provided by the pressure control valve creates a backpressure in the slave hydraulic pump, the equalization of the hydraulic pressures in the slave hydraulic pump and the hydraulic cylinder resulting in alternatively the supply and withdrawal of hydraulic fluid to and from the hydraulic cylinder response to a pressure differential, the distance from the combustion-chamber facing surface of the engine piston to the center of the pivotal connection of the connection rod to the crankshaft alternatively increasing and decreasing responsive to the volume of hydraulic fluid alternatively supplied and withdrawn from the hydraulic cylinder, and the compression ratio of the engine increasing when the distance is increased and the compression ratio decreasing when the distance is decreased.

2. The variable compression ratio system of claim 1, wherein the pre-determined rotational position of the crankshaft proximate which the commutating valve opens is proximate 270 degree after the top-dead-center position for the engine piston in the combustion cylinder.

3. The variable compression ratio system of claim 1 the reciprocating-piston engine having a plurality of combustion cylinders connected to the crankshaft, the variable compression ratio system further comprising:

a plurality of hydraulically operated variable length mechanisms, each one associated with a different one of the plurality of combustion cylinders; and a plurality of slave hydraulic pumps, each one connected to a different one of the plurality of hydraulically operated variable length mechanisms;

a plurality of discharge check valves, each one connected between a different one of the plurality of slave hydraulic pumps and the sink, and wherein each discharge check valve permitting flow of hydraulic fluid from the slave hydraulic pump to the sink and blocking flow in the opposite direction; and the source further having a plurality of injection check valves, each injection check valve connected to a different one of the plurality of slave hydraulic pumps.

* * * * *